US006286720B1

(12) United States Patent
Simmons et al.

(10) Patent No.: US 6,286,720 B1
(45) Date of Patent: Sep. 11, 2001

(54) BEVERAGE DISPENSER WITH AN IMPROVED COOLING CHAMBER CONFIGURATION

(75) Inventors: Darren W. Simmons, San Antonio; John Thomas Hawkins, Jr., Adkins, both of TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 0 days.

(21) Appl. No.: 09/326,527

(22) Filed: Jun. 4, 1999

(51) Int. Cl.[7] ..... B67D 5/56

(52) U.S. Cl. ..... 222/129.1; 222/146.6; 62/390

(58) Field of Search ..... 222/129.1, 129.2, 222/129.3, 129.4, 146.6; 62/390

(56) References Cited

U.S. PATENT DOCUMENTS

| | | | | |
|---|---|---|---|---|
| 3,892,335 | * | 7/1975 | Schroeder | 222/146.6 |
| 4,801,048 | * | 1/1989 | Credle, Jr. et al. | 222/146.6 |
| 5,368,198 | * | 11/1994 | Goulet | 222/129.1 |
| 5,499,744 | * | 3/1996 | Hawkins | 222/129.1 |
| 5,664,436 | * | 9/1997 | Hawkins, Jr. et al. | 62/390 |

* cited by examiner

*Primary Examiner*—Joseph A. Kaufman
(74) *Attorney, Agent, or Firm*—Christopher L. Makay

(57) ABSTRACT

A beverage dispenser with an improved component configuration for enhancing serviceability as well as increasing both the beverage dispensing capacity and the quantity of beverage dispensed at a cooler temperature while maintaining a compact size. The beverage dispenser includes a housing defining a cooling chamber having a cooling fluid contained therein, a water line, a product line, a rechill line substantially submerged within the cooling fluid, a carbonator within the cooling chamber coupled with the water line and a carbon dioxide gas source, dispensing valves mounted on the housing and coupled to the product lines and to at least one of the rechill line and the water line to deliver a beverage, and a refrigeration unit for cooling the cooling fluid. The refrigeration unit includes an evaporator coil substantially submerged within the cooling fluid. The evaporator coil, a one piece unit, includes a substantially concentric coil defined by an outer coil section and an inner coil section that is disposed within and substantially offset from the outer coil section for forming a uniformly distributed slab of frozen cooling fluid. The beverage dispenser includes a component configuration for enhancing serviceability including a mounting bracket for facilitating removal and attachment of component parts to the beverage dispenser without requiring an accompanying mounting screw to be separated from the beverage dispenser.

5 Claims, 4 Drawing Sheets

BEVERAGE DISPENSER WITH AN IMPROVED COOLING CHAMBER CONFIGURATION

BACKGROUND OF THE INVENTION

1. Field of the Invention

The present invention generally relates to beverage dispensers and, more particularly, but not by way of limitation, to a beverage dispenser with an improved component configuration which increases both the beverage dispensing capacity and the quantity of beverage dispensed at a cooler temperature.

2. Description of the Related Art

Self-service beverage dispensers are growing in popularity and availability. More people than ever before enjoy today's convenience of selecting a beverage of choice from a beverage dispenser. By placing a cup accordingly and activating a valve, the beverage dispenser dispenses a desired drink into the cup at a preset rate and at a desired temperature, such as the industry standard of less than 42° F.

Beverage dispensers introduced into new commercial settings must compete with other products for limited shelf space. Accordingly, there is a demand to design compact beverage dispensers, which can sufficiently serve a large number of customers. Consequently, compact designs featuring beverage dispensers with smaller and, thus, less effective internal refrigeration units compromise the ability to serve large numbers of customers beverages below the standard of 42° F. Ultimately, designers of compact beverage dispensers identified a need to increase the cooling efficiency of refrigeration units to accommodate large numbers of customers.

U.S. Pat. No. 5,368,198, which issued Nov. 29, 1994 to Goulet, discloses a beverage dispenser that attempts to combine compactness with increased beverage dispensing capacity. In operation, a refrigeration unit cools a cooling fluid within a cooling chamber so that the cooling fluid freezes in a slab about the refrigeration unit's evaporator coil, which is set within the cooling chamber. An agitator motor drives an impeller via a shaft to circulate unfrozen cooling fluid about the cooling chamber. Proper circulation requires a steady flow of the unfrozen cooling fluid from underneath the frozen cooling fluid slab, around its sides, over its top, and back through its center. Circulation of the unfrozen cooling fluid along this described path is essential to the heat transfer process which produces cool drinks and increases beverage dispensing capacity. Such circulation provides for the heat transfer between unfrozen cooling fluid and, relatively warmer, product, water, and carbonated water lines positioned within the cooling chamber.

Specifically, the unfrozen cooling fluid receives heat from the product and water lines as well as, in part, from the carbonated water line and delivers that heat to the frozen cooling fluid slab as it circulates about the cooling chamber. As such, the frozen cooling fluid melts to dissipate the heat from the product, water, and carbonated water so that a resulting cold beverage is dispensed as the cooled product and carbonated water or water act to form the desired drink. Unfortunately, the carbonated water line of the beverage dispenser disclosed in U.S. Pat. No. 5,368,198 fails to provide for the total cooling of carbonated water exiting the beverage dispenser's carbonator. In particular, by being exposed over time to the warmer surrounding atmosphere, a segment of the carbonated water line extending outside the bath of cooling fluid is subject to warming in that there is no desired heat exchange with the cooling fluid along the segment which diminishes the overall cooling efficiency of the beverage dispenser.

In addition, U.S. Pat. No. 5,368,198 features an evaporator coil consisting of two pieces bused together whereby a series of inner and outer coil sections reside along the same horizontal plane. Accordingly, a resulting frozen slab will bulge around the area where the inner and outer coil sections lie in the same horizontal plane such that unfrozen cooling fluid will encounter great difficulty in flowing through the channel defined by the hollowed interior portion of the slab. Thus, such improperly distributed bulges would greatly hinder or completely stop the free-flow of cooling fluid either by creating an undesirably narrow channel whereby cooling fluid could not satisfactorily flow therethrough or, in some cases, by completely freezing over the channel. In the same manner, bulges can completely freeze up an entire beverage dispenser by allowing the frozen slab of cooling fluid to grow and run into the walls of a cooling chamber. Such encumbrances acting against the free-flow of unfrozen cooling fluid thus diminishes the overall cooling efficiency of a beverage dispenser.

Accordingly, there is a long felt need for a compact beverage dispenser which occupies very little shelf space and permits the maximum transfer of heat between the product, water, and carbonated water lines and the unfrozen cooling fluid, thereby increasing cooling efficiency and, ultimately, drink dispensing capacity.

SUMMARY OF THE INVENTION

In accordance with the present invention, a beverage dispenser with an improved component configuration includes a housing defining a cooling chamber having a top and a bottom portion as well as a cooling fluid contained therein. The beverage dispenser includes a water line substantially submerged within the cooling fluid and coupled with a water source and a carbonator disposed within the cooling chamber and coupled with the water line and a carbon dioxide gas source. The beverage dispenser further includes a rechill line substantially submerged within the cooling fluid and coupled with the carbonator. Additionally, the beverage dispenser includes product lines, substantially submerged within the cooling chamber and coupled with a product source. Thus, a supply of chilled water, chilled carbonated water, and chilled product necessary for the formation of a desired drink by the beverage dispenser are provided by the carbonator, the water line, the rechill line, and the product lines.

Moreover, the rechill line and the water line are positioned in cooperation with each other for directing the flow of cooling fluid about the cooling chamber. To facilitate placement in the cooling chamber, the rechill line may assume a serpentine configuration formed by channels that direct the flow of cooling fluid about the cooling chamber.

The beverage dispenser still further includes dispensing valves mounted on the housing. The dispensing valves are coupled to the product lines and to at least one of the rechill lines and the water line to deliver a beverage.

A refrigeration unit including an evaporator coil positioned substantially centrally within the cooling chamber provides cooling for the cooling fluid. The evaporator coil, a one piece unit, includes a substantially concentric coil defined by an outer coil section and an inner coil section that is disposed within and substantially offset from the outer coil section. The substantially offset coils are an improved design to uniformly distribute the frozen slab that freezes about the evaporator coil so as to ultimately allow for the optimal flow of unfrozen cooling fluid around the frozen cooling fluid slab and through a channel defined by a hollowed interior portion of the slab. In particular, each inner and outer coil section develops a frozen cooling portion that freezes with an adjacent portion thus decreasing the formation time for creating a slab of frozen cooling fluid.

Furthermore, to ensure that the cooling fluid freezes to form a uniform slab with maximum cooling effect, an optimal horizontal distance and an optimal vertical distance between adjacent inner and outer coil sections, respectively, are provided. To further enhance heat transfer, the inner coil section and/or outer coil section may be substantially parallel to the top and bottom sections of the cooling chamber. The evaporator coil may also be configured with a rough outer surface texture, a thin wall thickness, and/or a material composition that best facilitates maximum heat transfer about the evaporator coil.

The beverage dispenser component configuration for enhancing serviceability includes a housing constructed in one seamless integral piece for preventing objects from falling therein, a housing platform mounted atop the housing, a compressor deck platform coupled with the housing platform to form one continuous surface that mounts atop the housing, and a compressor secured to the compressor deck platform. The housing includes a rounded configuration for enhancing serviceability. Moreover, the compressor deck platform is configured to be removed from and inserted with the housing platform.

The compressor deck platform includes an electronic components housing assembly secured atop the compressor deck platform and an agitator motor secured atop the compressor deck platform. The electronic components housing assembly and/or agitator motor are secured to the compressor deck platform by a mounting bracket and a mounting screw cooperatively engaged with the mounting bracket. The mounting bracket facilitates removal and attachment to the beverage dispenser without requiring the accompanying mounting screw to be separated from the beverage dispenser. The mounting bracket forms at least one slide aperture, each aperture including a removal portion which is wide enough to allow the head of the mounting screw to pass through the mounting bracket and a mounting portion which is narrow enough to keep the head of the mounting screw above the mounting bracket to secure the mounting bracket onto the beverage dispenser.

It is therefore an object of the present invention to provide a beverage dispenser with an improved component configuration for increasing both the beverage dispensing capacity and the quantity of beverage dispensed at a cooler temperature while maintaining a compact size.

It is a further object of the present invention to provide a beverage dispenser with enhanced cooling efficiency for maximum heat transfer between the unfrozen cooling fluid and the evaporator coil, the product line, the water line, and the carbonated water line.

It is still a further object of the present invention to provide a beverage dispenser including a component configuration for enhancing serviceability.

Still other objects, features, and advantages of the present invention will become evident to those skilled in the art in light of the following.

DETAILED DESCRIPTION OF THE PREFERRED EMBODIMENT

Figure 1:
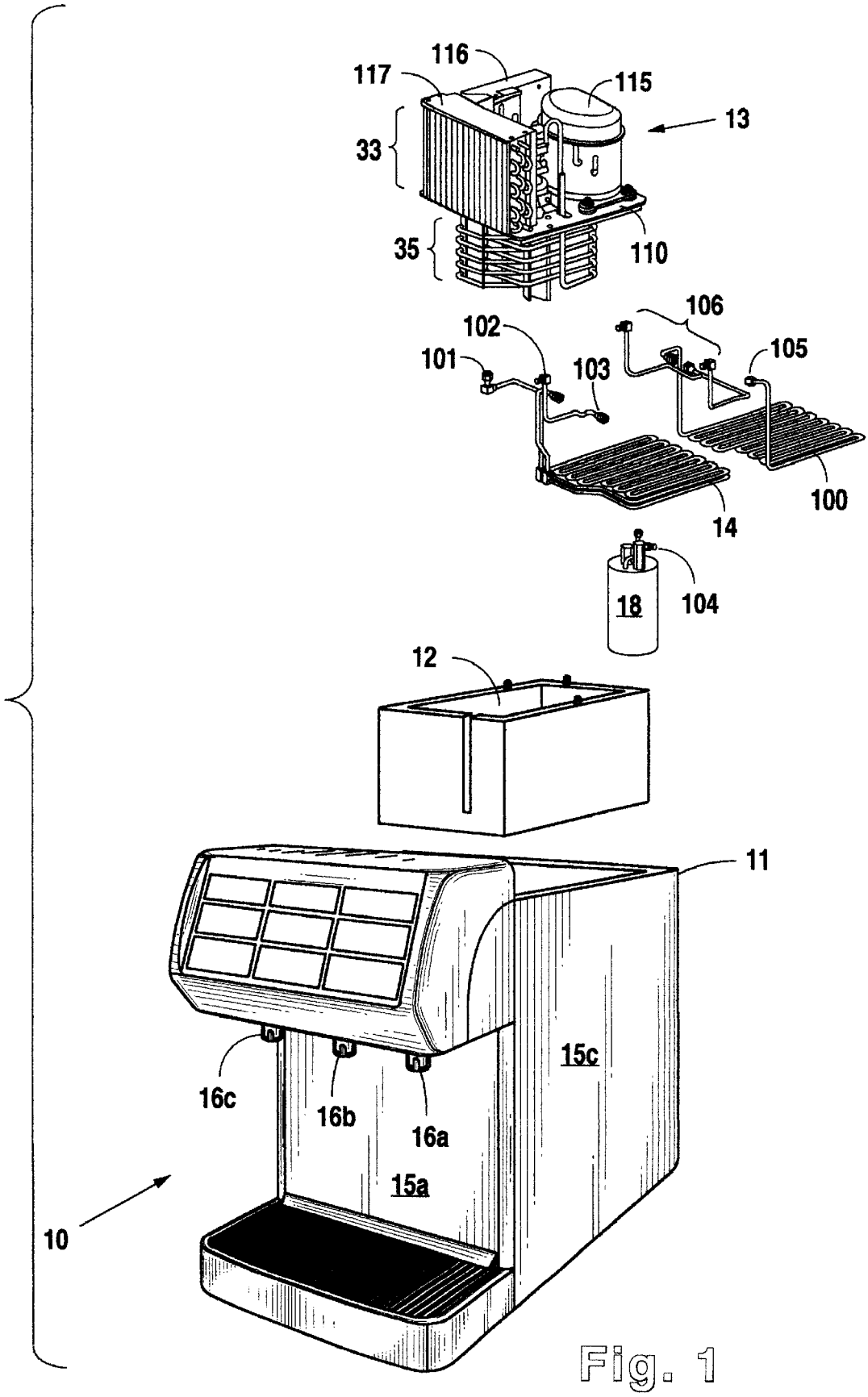
FIG. 1 is a perspective view illustrating a beverage dispenser featuring an improved cooling chamber configuration.

As required, detailed embodiments of the present invention are disclosed herein, however, it is to be understood that the disclosed embodiments are merely exemplary of the invention, which may be embodied in various forms. The figures are not necessarily to scale, and some features may be exaggerated to show details of particular components or steps.

As illustrated in FIGS. 1–5, beverage dispenser 10 includes a housing 11, a refrigeration unit 13, and dispensing valves 16A–C. Housing 11, in turn, includes a front wall 15A, a rear wall 15B, side walls 15C and D, and a bottom 15E that define a cooling chamber 12. Furthermore, cooling chamber 12 contains a cooling fluid, which is typically water.

Product lines 71–73 reside in front of cooling chamber 12 and mount therein using any suitable mounting means. Each of product lines 71–73 includes an inlet that communicates with a product source (not shown). Product lines 71–73 each further include an outlet that connects to dispensing valves 16A–C, respectively, to supply product to dispensing valves 16A–C. In an alternative embodiment, product lines 71–73 could each include a helical configuration to better facilitate heat transfer by providing greater surface area along each product line to thermodynamically interact with the circulating cooling fluid. An example of such a helical configuration is seen in U.S. patent application Ser. No. 09/136,086, the disclosure of which is incorporated herein by reference. Although three product lines and dispensing valves are disclosed, one of ordinary skill in the art will recognize that additional product and dispensing valves or that fewer product lines and dispensing valves may be implemented in any combination.

In the preferred embodiment, cooling chamber 12 includes a water line 14 having a serpentine configuration to permit its placement on the bottom of cooling chamber 12. Water line 14 mounts to the bottom 15E of housing 11 using any suitable mounting means. An inlet 101 into water line 14 connects to main water pump 75 which, in turn, connects to any suitable external water source such as a public water line. The placement of the water line 14 on the bottom of cooling chamber 12, so that it is substantially submerged within the cooling fluid, allows for the water within the water line 14 to be chilled via heat transfer with the relatively cooler cooling fluid. Chilling the water within water line 14 serves two distinct functions. First, the beverage dispenser 10 may dispense chilled, plain water through a plain water outlet 102 of the water line 14, and, second, plain water within the water line 14 is "prechilled" before delivery into a carbonator 18 disposed in cooling chamber 12. In particular, an outlet 103 from water line 14 connects to a T-connector, which delivers the water received from the water line 14 to carbonator 18. Additionally, carbonator 18 connects to and receives carbon dioxide from a carbon dioxide source (not shown) to carbonate the water delivered from water line 14. Carbonator 18 mounts within the front of the cooling chamber 12 using any suitable mounting means.

Because a relatively small amount of chilled water is diverted by the plain water outlet 102, the majority of the chilled water within water line 14 is carbonated upon passing through carbonator 18. Water chilled prior to delivery to carbonator 18 is highly desirable because it enhances the carbonation process.

In this preferred embodiment, cooling chamber 12 includes a rechill line 100 whereby carbonated water exits carbonator 18 through outlet 104 and enters rechill line 100 via inlet 105. Rechill line 100 includes a serpentine configuration to permit its placement on the bottom of cooling chamber 12. Rechill line 100 is positioned in cooperation with water line 14 so that both the rechill line 100 and the water line 14 act together to direct the flow of unfrozen cooling fluid about cooling chamber 12, as is discussed below. Moreover, by placing rechill line 100 on the bottom of the cooling chamber so that it is substantially submerged within the cooling fluid, rechill line 100 allows for carbonated water therein to be "rechilled" via heat transfer with the relatively cooler cooling fluid.

The introduction of rechill line 100 into the cooling chamber 12 significantly increases the dispensing capacity of the beverage dispenser 10. The rechill line 100 significantly increases the ability of the beverage dispenser 10 to dispense carbonated water and, thus, drinks at or below the industry standard temperature, especially when the dispensing valves 16A–C have not been used for a prolonged period, because rechill line 100 remains submerged in the cooling fluid until a drink is ready to be dispensed. More particularly, cooled carbonated water from rechill line 100 combines with cooled product from product lines 71–73 to form a relatively colder beverage, as compared to beverage dispensers without a rechill line, thereby greatly enhancing the beverage dispensing capacity of the beverage dispenser 10 without increasing its overall size.

When a desired beverage is accessed through one of the dispensing valves 16A–C, carbonated water exits the rechill line 100 through outlets 106 and enters a designated dispensing valve so as to be mixed with the desired product and then dispensed into a cup below. Product pumps 76–78 are provided to pump the desired product from the product lines 71–73 to the dispensing valves 16A–C. The dispensing valves 16A–C, in turn, are secured to the front wall 15A of housing 11 by a faucet plate 16D. (See FIG. 2). A drip tray 123 is provided beneath the dispensing valves 16A–C. The drip tray 123 is secured to the lower portion of front wall 15A using any suitable means to collect beverage drippings emitted by the valves above. In addition, an easy to clean splash plate 122 is secured using any suitable means onto the forward facing surface of front wall 15A to protect the beverage dispenser 10 against the unwanted accumulation of beverage drippings and splashings from the valves.

In this preferred embodiment, cooling chamber 12 includes refrigeration unit 13. Refrigeration unit 13 is a standard beverage dispenser refrigeration system that includes a compressor 115, a condenser assembly 33, and a compressor deck platform 110. Condenser assembly 33, in turn, includes a condenser coil 34, a fan 36 to blow air across condenser coil 34 thereby facilitating heat transfer, and an air directing shroud 117 that houses the condenser coil 34 and supports the fan 36. The air directing shroud 117 is optimally configured to facilitate heat transfer between the condenser coil 34 and the air blown by fan 36. Fan 36 mounts onto and condenser coil 34 is secured within the air directing shroud 117 using any suitable mounting means.

The compressor 115 and the condenser assembly 33 as well as an electronics components housing assembly 116 and an agitator motor 37 mount on top of the compressor deck platform 110 while an evaporator coil 35 mounts underneath. Compressor deck platform 110 is integrally secured to a housing platform 38 so as to form one continuous surface that mounts on top of housing 11 such that evaporator coil 35 resides substantially submerged within the cooling fluid, just above water line 14 and rechill line 100 and substantially about the central portion of cooling chamber 12. Moreover, compressor deck platform 110 is configured to be easily removed from housing platform 38 during cleaning or maintenance. In addition to compressor deck platform 110, main pump 75 and mini pumps 76–78 are secured to housing platform 38.

Refrigeration unit 13 operates similarly to any standard beverage dispenser refrigeration system to cool the cooling fluid residing within cooling chamber 12 such that the cooling fluid freezes in a slab about evaporator coil 35. Refrigeration unit 13 cools and ultimately freezes the cooling fluid to facilitate heat transfer between the cooling fluid and the product, water, and carbonated water so that a cool beverage may be dispensed from beverage dispenser 10. However, because complete freezing of the cooling fluid results in an inefficient heat exchange, a cooling fluid bank control system (not shown), within the electronic components housing assembly 116, regulates the compressor 115 to prevent the complete freezing of the cooling fluid such that the compressor 115 never remains activated for a time period sufficient to allow the frozen cooling fluid slab to grow onto product lines 71–73.

In this preferred embodiment, evaporator coil 35 is a one piece unit defined by an alternating series of substantially offset coils; i.e. an inner coil section 35*a* and an outer coil section 35*b*, positioned substantially centrally in cooling chamber 12. (See FIGS. 3–4). The coils sections are substantially offset in that each outer coil section 35*b* resides in a different horizontal plane from the interior coil section 35*a*. The substantially offset coils are an improved design to uniformly distribute the frozen slab that freezes about evaporator coil 35 so as to ultimately allow for the optimal flow of unfrozen cooling fluid around the frozen cooling fluid slab and through a channel defined by the hollowed interior portion of the slab.

By contrast, U.S. Pat. No. 5,368,198 features an evaporator coil having a series of inner coil sections and outer coil sections residing along the same horizontal plane. Accordingly, the '198 evaporator coil will develop improperly distributed bulges of frozen cooling fluid around the area where the inner coil sections and outer coil sections lie in the same horizontal plane. Collectively, these bulges define a nonuniform frozen slab that greatly hinders or completely stops the free-flow of cooling fluid about the cooling chamber. In particular, the bulges either create an undesirably narrow channel within the frozen slab whereby cooling fluid could not satisfactorily flow therethrough or, in some cases, completely freeze over the channel as well as the entire beverage dispenser.

Figure 4:
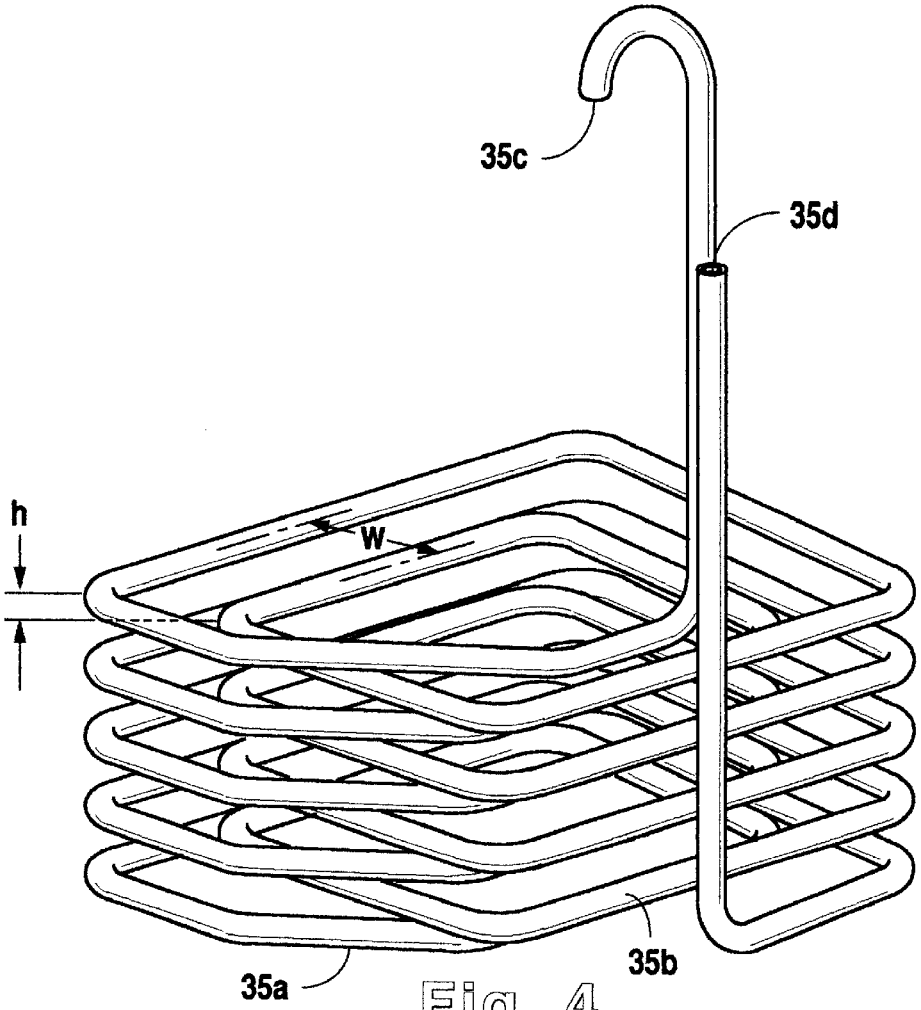
FIG. 4 is a perspective view illustrating the preferred embodiment of an evaporator coil featured within the improved cooling chamber configuration.
Figure 5:
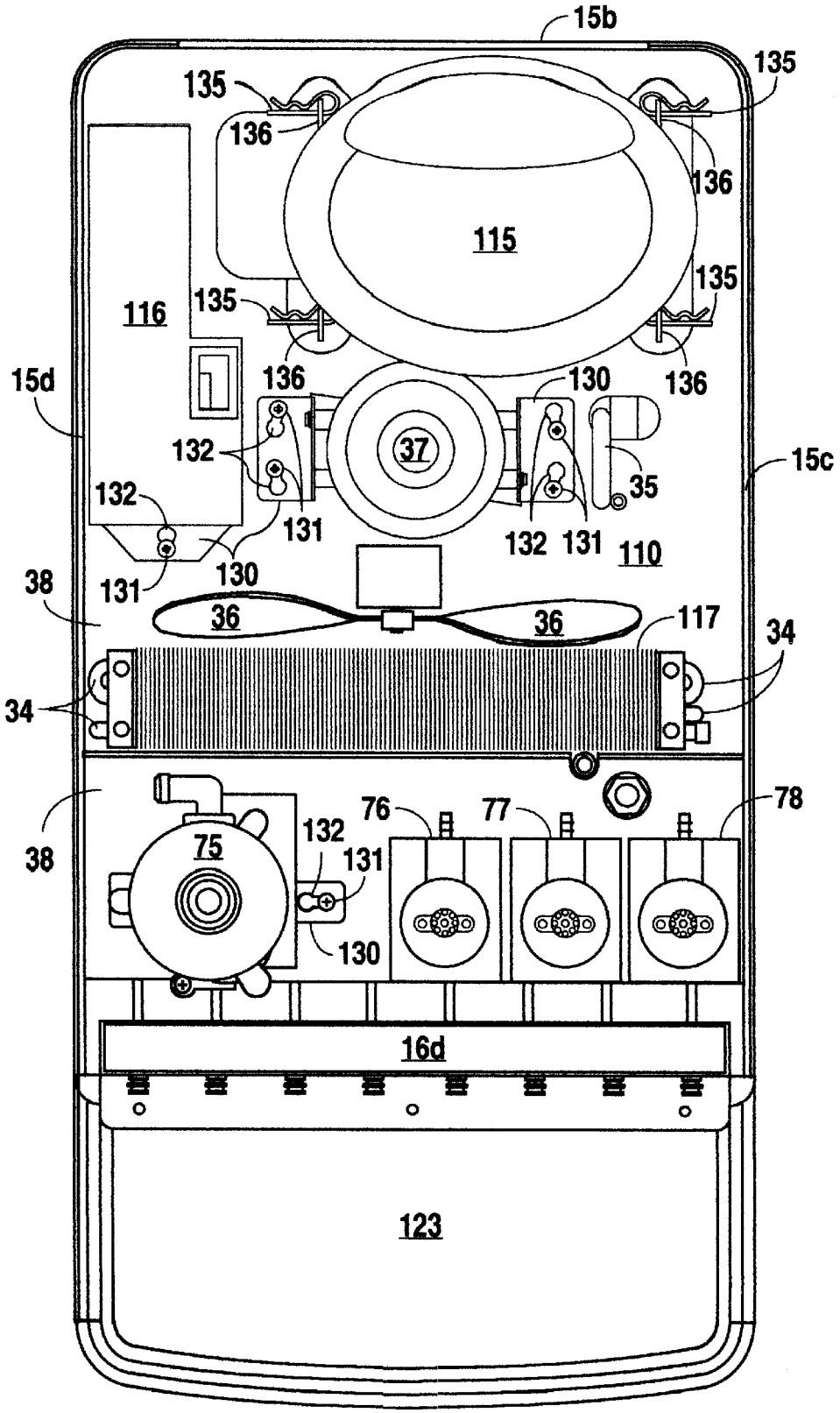
FIG. 5 is a top elevation view illustrating various components of the beverage dispenser positioned on a platform that is situated above the cooling chamber.

As such, evaporator coil 35 includes an inlet 35*c* and an outlet 35*d* through which a refrigerant fluid continuously flows thereby allowing cooling fluid to freeze about the evaporator coil 35 when in operation. As shown in FIG. 4, to ensure that the cooling fluid freezes to form a uniform slab with maximum cooling effect, an optimal height, h, and an optimal width, w, between adjacent inner and outer coil sections 35*a* and 35*b*, respectively, are provided.

The outer surface texture of the inner and outer coil sections, 35*a* and 35*b*, can each be configured to allow for different rates of heat transfer. For example, coil sections with a rough texture slow the flow rate of cooling fluid by allowing the fluid to "cling" to the coil section for a longer time to facilitate growth of frozen cooling fluid about evaporator coil 35. In much the same way as the outer surface texture can be configured, those skilled in the art will recognize that the wall thickness of the coil sections can be configured to accommodate different rates of heat transfer. The material composition of the coil sections can also be configured by those skilled in the art to accommodate different rates of heat transfer for facilitating the growth of a uniformly distributed frozen cooling fluid slab.

Agitator motor 37 mounts onto compressor deck platform 110 to drive, via a shaft (not shown), an impeller (not shown) set within the unfrozen cooling fluid and secured to the end of the shaft. Agitator motor 37 drives the impeller to circulate the unfrozen cooling fluid around the frozen cooling fluid slab as well as about water line 14, rechill line 100, and product lines 71–73. The impeller circulates the unfrozen cooling fluid to enhance the transfer of heat, which naturally occurs between the lower temperature cooling fluid and the higher temperature product, water, and carbonated water. Heat transfer results from the product, water, and carbonated water flowing through product lines 71–73, water line 14, and rechill line 100, respectively, which give up heat to the unfrozen cooling fluid. The unfrozen cooling fluid, in turn, transfers the heat to the frozen cooling fluid slab which receives that heat and melts in response, thereby completing the thermodynamic cycle by providing "liquid" or unfrozen cooling fluid into cooling chamber 12. The heat originally transferred from the product, water, and carbonated water into the cooling fluid is continuously dissipated through the melting of the frozen cooling fluid slab. Accordingly, that dissipation of heat and corresponding melting of frozen cooling fluid slab maintain the frozen cooling fluid at the desired temperature of 32° F., which is ideally below the industry standard.

The effectiveness of the above-described transfer of heat directly relates to the amount of surface area contact between the unfrozen cooling fluid and the frozen cooling fluid slab. That is, if the unfrozen cooling fluid contacts the frozen cooling fluid slab along a maximum amount of its surface area, the transfer of heat significantly increases. Beverage dispenser 10 maintains maximum contact of unfrozen cooling fluid along the surface of the frozen cooling fluid slab due to the positioning of the water line 14 and rechill line 100 at the bottom portion of the cooling chamber 12 and the placement of product lines 71–73 at the front portion of cooling chamber 12. Maximum contact is further achieved due to the serpentine configurations of water line 14 and rechill line 100 as well as the helical configuration of product lines 71–73.

Specifically, the removal of product lines and water lines from the center of the evaporator coil eliminates the obstruction to the flow of unfrozen cooling fluid experienced by beverage dispensers having one or both of the product and water lines centered within the evaporator coil. Furthermore, by increasing the size of evaporator coil 35, a larger frozen cooling slab forms. Particularly, the placement of the product lines 71–73 in the front portion of cooling chamber 12 permits the size of evaporator coil 35 to be increased without a corresponding increase in the height of housing 11. A larger frozen cooling fluid slab provides a greater surface area for the transfer of heat with the unfrozen cooling fluid. That increase in cooling efficiency through heat transfer from the unfrozen cooling fluid to the frozen cooling fluid slab maintains the unfrozen cooling fluid at 32° F., even during peak use periods of beverage dispenser 10. Consequently, the ability to increase the heat extracted from the product and water significantly increases the overall beverage dispensing capacity of beverage dispenser 10. Moreover, through the above modifications, this increased efficiency optimally facilitates the introduction of the rechill line 100 into the cooling chamber 12 to permit the extraction of heat from the carbonated water within the rechill line 100 by the unfrozen cooling fluid, thereby further enhancing the ability of beverage dispenser 10 to continuously serve beverages well below the industry standard.

Figure 2:
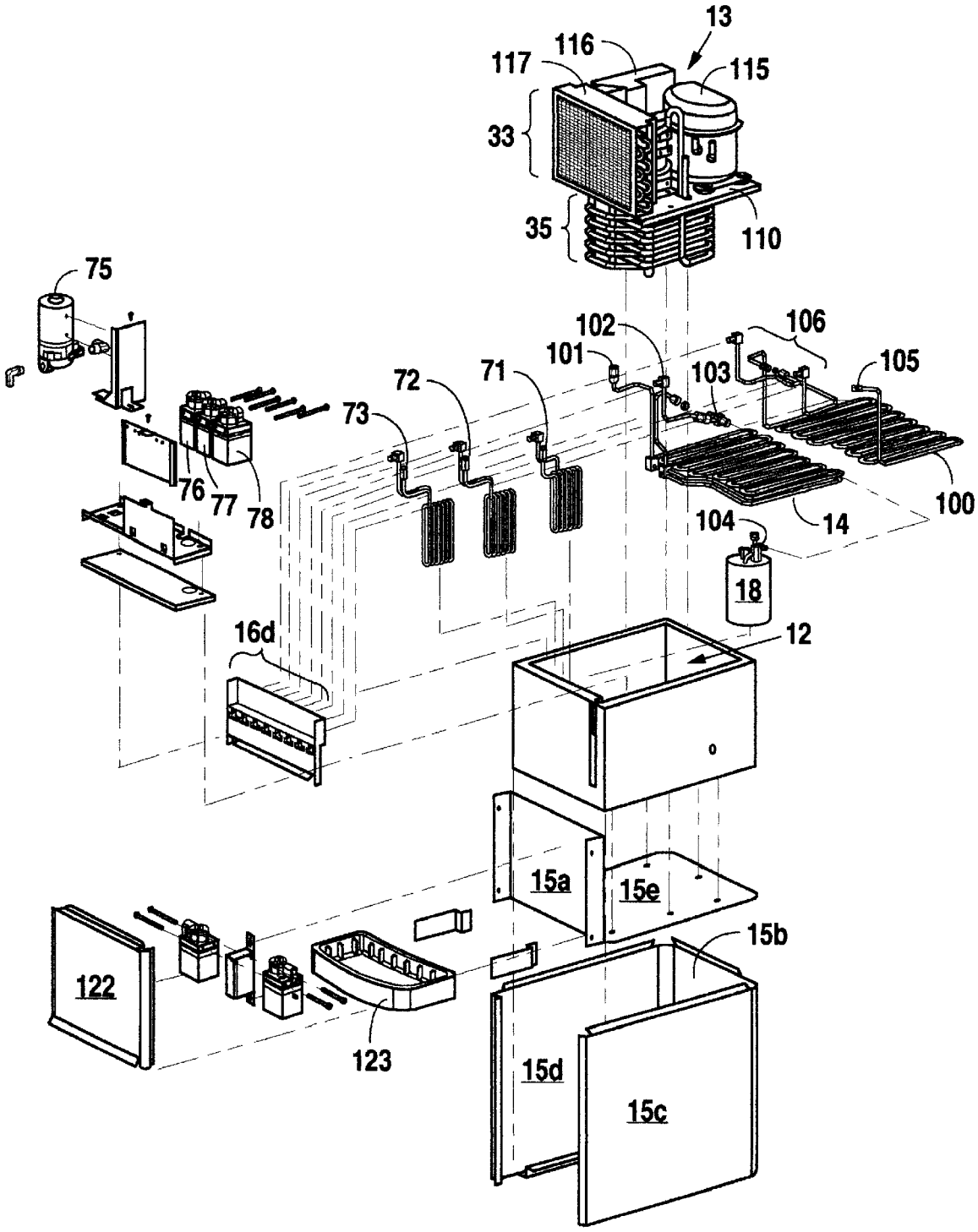
FIG. 2 is an exploded view illustrating the beverage dispenser.
Figure 3:
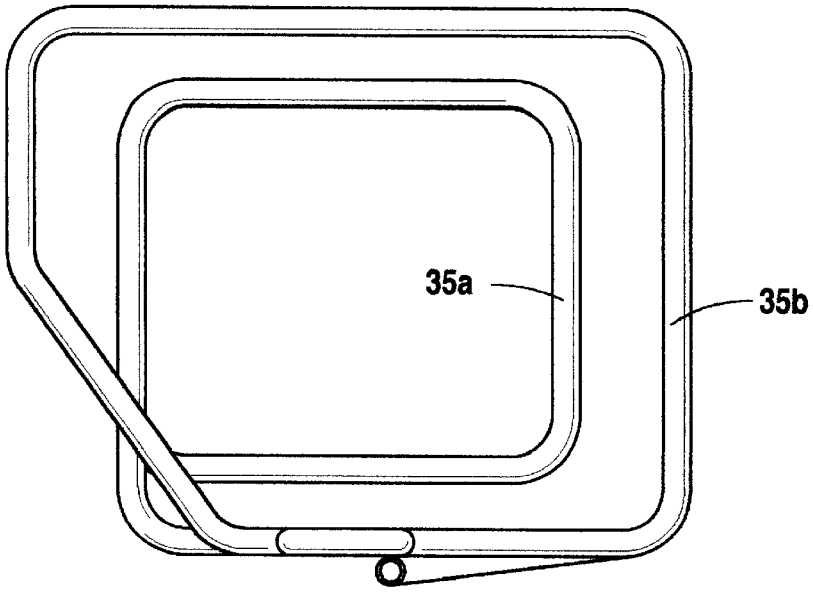
FIG. 3 is a top elevation view illustrating the preferred embodiment of an evaporator coil featured within the improved cooling chamber configuration.

The serpentine configuration of water line 14 increases the effectiveness of the circulation of unfrozen cooling fluid by the impeller. As shown in FIGS. 1–2, the serpentine configuration of water line 14 produces channels that direct the flow of unfrozen cooling fluid toward front wall 15A and back wall 15B of housing 11.

In the same manner, the serpentine configuration of rechill line 100 increases the effectiveness of the circulation of unfrozen cooling fluid by the impeller. As shown in FIGS. 1–2, the serpentine configuration of rechill line 100 produces channels that direct the flow of unfrozen cooling fluid toward front wall 15A and back wall 15B of housing 11. In addition, rechill line 100 is positioned in cooperation with water line 14 so that both the rechill line 100 and the water line 14 act together to direct the flow of unfrozen cooling fluid about cooling chamber 12.

The outer surface textures of the rechill line 100 and/or water line 100 can also be configured to allow for different rates of heat transfer. For example, a rechill and/or water line having a rough texture slows the flow rate of cooling fluid by allowing the fluid to "cling" to the channels for a longer time so as to further cool the fluid within that line. In much the same way as the outer surface texture can be configured, those skilled in the art will recognize that the wall thickness of a rechill and/or water line can be configured to accommodate different rates of heat transfer. The material composition of the rechill and/or water line can also be configured by those skilled in the art to accommodate different rates of heat transfer for facilitating better thermal absorption at cooler temperatures.

It must also be emphasized that beverage dispenser 10 is configured for easy cleaning and serviceability in little time and with a minimum number of tools required. In the past, screws and/or other means for mounting included within beverage dispenser 10 would be lost by falling within various crevices about the beverage dispenser 10 or by falling within the cooling chamber 12 where they would often conglomerate with the slab of frozen cooling fluid. In some cases, screws from the manufacturer were not easy to replace through a trip to the local hardware store, resulting in a lack of replacement of the screws or the use of non-standard attachment means. Beverage dispenser 10 fulfills the past need for easy cleaning and serviceability by eliminating the above problems.

Accordingly, main water pump 75 and product pumps 76–78 are placed near the front of the beverage dispenser 10 for easy access during cleaning and maintenance. Several electronic components, including the cooling fluid bank control system, have been centralized and housed within the electronic components housing assembly 116 which is located on top of the compressor deck platform 110. In this preferred embodiment, the rectangular housing 11 of beverage dispenser 10 is rounded about its edges to allow for easy lifting and transport, and unwanted holes, gaps, and crevices about the beverage dispenser 10 have been closed to prevent screws and other small objects from falling therein. (See FIG. 5).

Agitator motor 37, electronic components housing assembly 116, and main pump 75 each feature at least one mounting bracket 130, which facilitates the attachment and the removal of such components from the beverage dispenser 10 without the removal of accompanying mounting screws 131 for at least one bracket 130. In particular, each mounting bracket 130 features at least one slide aperture 132. The slide aperture 132 includes a removal portion which is wide enough to allow the head of mounting screw 131 to pass through mounting bracket 130 and a mounting portion which is narrow enough to keep the head of the mounting screw 131 above the mounting bracket 130 so that the mounting bracket 130 is firmly secured onto the beverage dispenser 10. In operation, mounting screw 131 is sufficiently loosened to allow mounting bracket 130 to be moved in a manner such that the head of mounting screw 131 slides along the upper portion of slide aperture 132 from the mounting portion to the removal portion. The mounting bracket 130 is then lifted away from the beverage dispenser 10 by allowing the head of the mounting screw 131 to pass through the mounting bracket. Thus, the mounting screw 131 is never completely removed from the beverage dispenser 10 and is only sufficiently loosened for the mounting bracket 130 to slide out, thereby eliminating the once frequent problem of lost mounting screws. In a manner opposite to that described above, the mounting bracket 130 is affixed to the beverage dispenser 10.

Furthermore, in this preferred embodiment, compressor 115 features at least one clip 135 and at least one corresponding loop 136, which facilitate the attachment and the removal of compressor 115 from the beverage dispenser 10. In particular, the loop 136 is secured to the surface of the compressor deck platform 110 using any suitable means. Thus, the compressor 115 is removed from the compressor deck platform 110 by removing the clip 135 from the loop 136 and then lifting the compressor 115 away from the beverage dispenser 10. It should be also emphasized that one of ordinary skill in the art will recognize that other suitable mounting means for components within the beverage dispenser 10 other than the mounting bracket 130 as well as the clip 135 and loop 136 described above may be used.

In operation, agitator motor 37 drives the impeller to force unfrozen cooling fluid from the channel defined by the interior surface of the hollowed slab of frozen cooling fluid toward water line 14 and rechill line 100. As the forced flow of unfrozen cooling fluid approaches the wound channels of water line 14 and rechill line 100, these channels direct the unfrozen cooling fluid toward the front wall 15A and back wall 15B of housing 11. More particularly, the channels direct a first stream of unfrozen cooling fluid toward the front wall 15A and a second stream of unfrozen cooling fluid toward the rear wall 15B.

As the first stream of unfrozen cooling fluid flows into the front portion of cooling chamber 12, it contacts product lines 71–73 to remove heat from the product flowing therein. Furthermore, the unfrozen cooling fluid contacts the frozen cooling fluid slab to transfer heat therebetween. Likewise, as the second stream of unfrozen cooling fluid flows into the rear portion of cooling chamber 12, it contacts the frozen cooling fluid slab to produce heat transfer therebetween.

The first and second streams of unfrozen cooling fluid circulate from the front and rear portions of the cooling chamber 12, respectively, into the top portion of cooling chamber 12. As the first and second streams of unfrozen cooling fluid enter the top portion of cooling chamber 12, they contact the top of the frozen cooling fluid slab to produce heat transfer therebetween. Furthermore, the first and second streams of unfrozen cooling fluid flow into the channel defined by the interior surface of the frozen cooling fluid slab where such streams recombine to contact the frozen cooling fluid slab for a further heat transfer. The recombined cooling fluid stream entering the channel is again forced from the channel toward water line 14 and rechill line 100 by the impeller in a manner so that the above-described circulation repeats.

Additionally, the impeller propels unfrozen cooling fluid from the channel of the frozen cooling fluid slab toward side walls 15C and D. The unfrozen cooling fluid divides into third and fourth streams of unfrozen cooling fluid which travel a circuitous path around the sides of the frozen cooling fluid slab, over the top of the frozen cooling fluid slab, and back to the channel defined by the slab of frozen cooling fluid. That flow of the third and fourth streams of unfrozen cooling fluid produces additional heat transfer from the product, water, and carbonated water to the unfrozen cooling fluid.

Accordingly, the completely unobstructed path for unfrozen cooling fluid about all sides of the frozen cooling fluid slab as well as through the channel of the frozen cooling fluid slab provides maximum surface area contact between frozen and unfrozen cooling fluid. That maximum surface area contact results in maximum heat transfer from the product, water, and carbonated water to the unfrozen cooling fluid and, in turn, to the frozen cooling fluid slab. Consequently, beverage dispenser 10 exhibits an increased beverage dispensing capacity because the unfrozen cooling fluid maintains a temperature, below the industry standard, of approximately 32°F. even during peak use periods due to its increased circulation and corresponding increased heat transfer capacity.

Without the constant circulation of unfrozen cooling fluid, the same unfrozen cooling fluid would remain between the frozen cooling fluid slab and the front, rear, and side walls 15A, 15B, and 15 C–D, respectively. Eventually, that unagitated unfrozen cooling fluid would freeze because it would not receive sufficient heat from the product, water, and carbonated water to prevent its freezing. Accordingly, the increased circulation of unfrozen cooling fluid produced by the above mentioned configuration of beverage dispenser 10 not only produces a larger beverage dispensing capacity in beverage dispenser 10, but it also prevents a freeze-up of cooling fluid which would severely limit beverage dispensing capacity.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims which follow.

We claim:

1. A beverage dispenser, comprising:

a housing defining a cooling chamber having a cooling fluid contained therein;

a refrigeration unit for cooling the cooling fluid, the refrigeration unit including an evaporator coil positioned substantially centrally within the cooling chamber;

a water line coupled with a water source wherein the water line is positioned within the cooling chamber and substantially submerged within the cooling fluid underneath the evaporator coil for providing chilled plain water;

a carbonator coupled with the water line and with a carbon dioxide gas source, wherein the carbonator is disposed within the cooling chamber for providing a supply of carbonated water;

product lines coupled with a product source and substantially submerged within the cooling chamber for providing chilled product;

a rechill line coupled to the carbonator wherein the rechill line resides substantially completely on the bottom of the cooling chamber and is substantially submerged within the cooling fluid underneath the evaporator coil for providing chilled carbonated water; and dispensing valves mounted on the housing and coupled to the product lines and at least one of the rechill line and the water line to deliver a beverage.

2. The beverage dispenser according to claim 1 wherein the rechill line and the water line are positioned in cooperation with each other for directing the flow of cooling fluid about the cooling chamber.

3. The beverage dispenser according to claim 1 wherein the rechill line defines a serpentine configuration to facilitate placement within the cooling chamber.

4. The beverage dispenser according to claim 3 wherein the serpentine configuration of the rechill line forms channels to direct the flow of cooling fluid about the cooling chamber.

5. The beverage dispenser according to claim 1 wherein the cooling chamber includes a bottom and a top portion.

* * * * *